US006701824B2

(12) United States Patent
Forster

(10) Patent No.: US 6,701,824 B2
(45) Date of Patent: Mar. 9, 2004

(54) AXIAL PISTON MACHINE

(75) Inventor: Franz Forster, Karlstadt-Muhlbach (DE)

(73) Assignee: Linde Aktiengesellschaft (DE)

( * ) Notice: Subject to any disclaimer, the term of this patent is extended or adjusted under 35 U.S.C. 154(b) by 92 days.

(21) Appl. No.: 10/104,998

(22) Filed: Mar. 22, 2002

(65) Prior Publication Data

US 2002/0144592 A1 Oct. 10, 2002

(30) Foreign Application Priority Data

Mar. 23, 2001 (DE) ..... 101 14 181

(51) Int. Cl.[7] ..... F01B 3/00
(52) U.S. Cl. ..... 92/12.2; 180/308
(58) Field of Search ..... 92/12.2; 475/83; 188/71.5; 180/308

(56) References Cited

U.S. PATENT DOCUMENTS 5,918,529 A * 7/1999 Forster ..... 92/12.2
6,248,037 B1 * 6/2001 Forster ..... 180/308
6,260,653 B1 * 7/2001 Forster ..... 180/308
6,334,512 B1 1/2002 Forster ..... 188/715

FOREIGN PATENT DOCUMENTS

DE 198 54 415 A1 2/2000
DE 19849334 A1 * 4/2000 ..... F03C/1/06

* cited by examiner

*Primary Examiner*—Thomas E. Lazo
(74) *Attorney, Agent, or Firm*—Webb Ziesenheim Logsdon Orkin & Hanson, P.C.

(57) ABSTRACT

An axial piston machine with a swashplate and a cylinder block provided with a torque transmission member is rotationally mounted by a bearing system located radially between the cylinder block and a housing. To achieve compact dimensions and an improved supply of hydraulic fluid, the cylinder block and the swashplate are penetrated centrally by two plain coaxial conduits that are connected on the swashplate-side ends to hydraulic fluid supply channels and emerge on the cylinder-block-side ends in a control body which has a control surface that interacts with the cylinder block. The control body is located inside the cylinder block. The plain conduits are supported in a swashplate mounting and in the cylinder block. The axial piston machine is preferably realized in the form of a wheel motor.

19 Claims, 1 Drawing Sheet

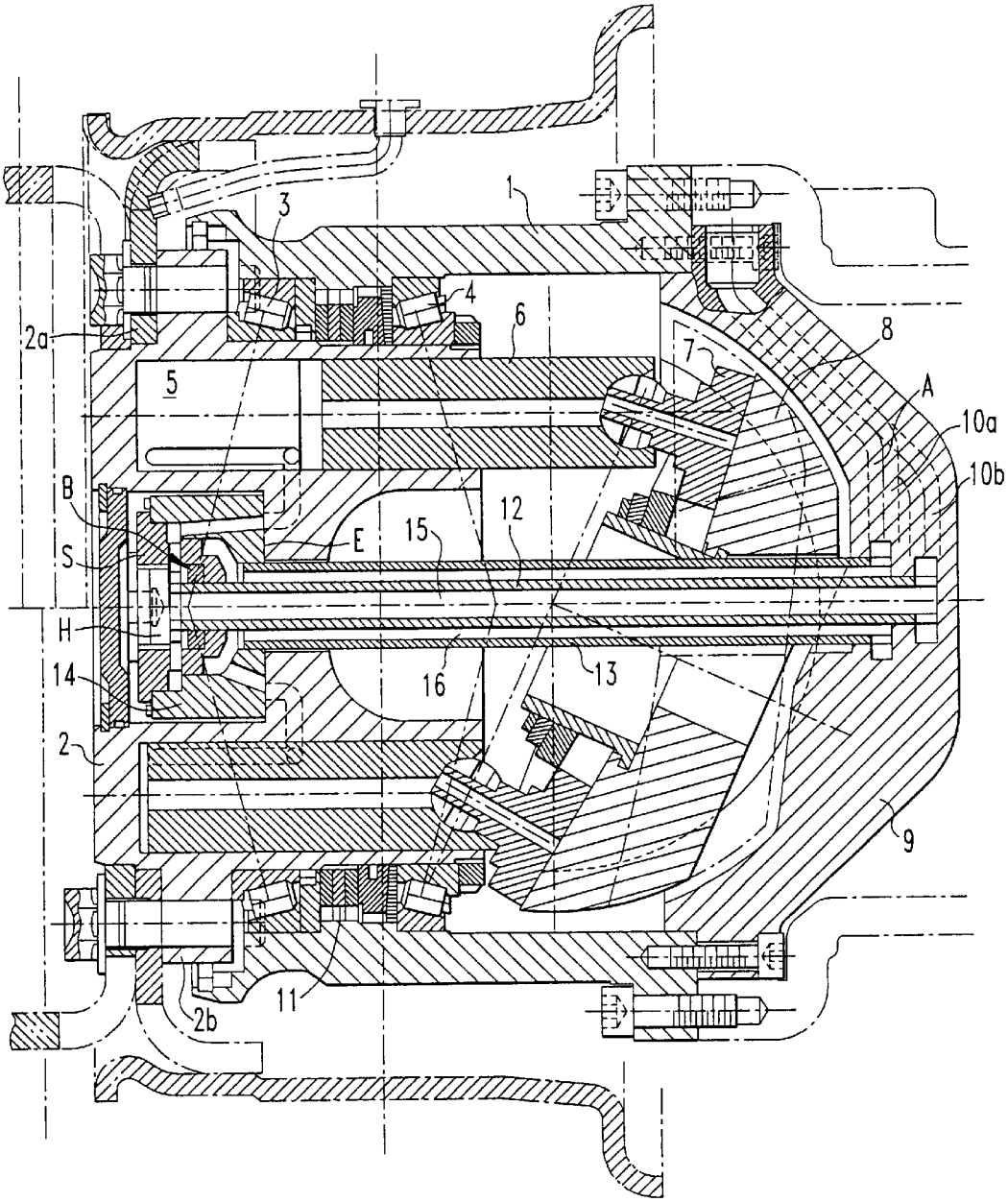
1
2
2a
2b
3
4
5
6
7
8
9
10a
10b
11
12
13
14
15
16
A
B
E
H
S

AXIAL PISTON MACHINE

BACKGROUND OF THE INVENTION

1. Field of the Invention

This invention relates to an axial piston machine with a swashplate and a cylinder block provided with a torque transmission member rotationally mounted by a bearing system which is located radially between the cylinder block and a housing.

2. Background Information

A similar axial piston machine of the prior art is described in DE 198 54 415 A1. In contrast to conventional axial piston machines that utilize the swashplate construction, it does not have a drive shaft on which the cylinder block is mounted. Rather, the cylinder block has an "external bearing system". The feed and discharge of hydraulic fluid to and from the cylinder bores that are worked into the cylinder block takes place through channels in the swashplate, the slippers and the work pistons. The control surface is therefore located on the swashplate. On account of the relatively large diameter of the control surface, a high degree of manufacturing accuracy is required to keep leak losses low, and that makes the manufacturing process correspondingly complex, time-consuming and expensive.

The object of the invention is to make available an axial piston machine of the type described above which is compact and has an improved hydraulic supply system.

SUMMARY OF THE INVENTION

This object is accomplished by the invention, in which the cylinder block and the swashplate are penetrated centrally by two plain conduits which are coaxial to each other, are connected on the swashplate-side ends to hydraulic fluid supply channels, and emerge at the cylinder-block-side ends in a control body which has a control surface that interacts with the cylinder block.

The teaching of the invention is accordingly to use the space made available inside the axial piston machine by the elimination of the drive shaft for the supply of hydraulic fluid to the cylinder bores. It thereby becomes possible to make available, in the vicinity of the cylinder block, a control surface which has small dimensions and extremely low oil leakage losses, and therefore, offers advantages in terms of the simplification of the manufacturing processes required.

To minimize the dimensions of the axial piston machine of the invention, the invention teaches that the control body is located inside the cylinder block.

The plain conduits are appropriately supported in a swashplate mounting and in the cylinder block.

The rotating cylinder block can be stopped by a brake, in particular a spring-loaded, multiple-disc brake, which can be located radially between the cylinder block and the housing.

In that case, it is advantageous for reasons of space if the brake is located axially between two tapered roller bearings of the bearing system, in particular two conical roller bearings in an O-arrangement.

In one particularly advantageous configuration of the invention, the bearing system can absorb the forces generated by the drive system as well as external forces. Therefore no separate bearing is required to absorb the external forces, such as for example, the wheel forces.

The axial piston machine of the invention can therefore be advantageously realized in the form of a wheel motor. The wheel motor in question has direct drive, i.e., it drives a wheel without a reducing transmission.

For the application described above, it is advantageous if a rim driver flange is shaped onto the cylinder block. It thereby becomes possible to minimize the number of components that have to be assembled.

The same advantage can be achieved by a configuration in which a rim centering device is shaped onto the cylinder block.

BRIEF DESCRIPTION OF THE DRAWING

Additional advantages and details of the invention are explained in greater detail below with reference to the exemplary embodiment of the invention which is schematically illustrated in the accompanying drawing. The drawing shows an axial piston machine that employs the swashplate construction and is realized in the form of a wheel motor.

DETAILED DESCRIPTION OF THE PREFERRED EMBODIMENT

A cylinder block 2 is mounted in a housing 1 by a system of external bearings consisting of two tapered roller bearings (in this case, conical roller bearings in an 0-arrangement) 3 and 4. In other words, the tapered roller bearings 3 and 4 are located radially between the cylinder block 2 and the housing 1. The bearing system at least partly absorbs the forces generated by the drive mechanism, as well as the external forces (wheel forces).

Worked into the cylinder block 2 are concentric cylinder bores 5, in each of which there is a work piston 6 which is supported by a slipper 7 on a swashplate 8, which in this exemplary embodiment is adjustable. The swashplate 8 is pivotably mounted in a swashplate mounting 9 in which there are supply channels 10*a*, 10*b* (indicated in broken lines) for the hydraulic fluid. Of course, it is also possible to realize the axial piston machine with a constant intake volume.

Radially between the cylinder block 2 and the housing 1 and axially between the two tapered roller bearings 3 and 4 of the bearing system there is a brake 11 which is a wet, spring-loaded, multiple-disc brake 11. Shaped onto the cylinder block 2 are a rim centering device 2*a* and a rim driver flange 2*b* (torque drive or torque transmission member).

Both the cylinder block 2 and the swashplate 8 are penetrated centrally by two plain conduits 12 and 13 which are coaxial to each other and are supported in the cylinder block 2 and on the swashplate side in the swashplate mounting 9. To absorb forces in the axial direction, the inner plain conduit 12 is connected to the swashplate mounting 9 in an area A by a threaded connection. An axially movable control body 14 which is located inside the cylinder block 2 and is supported on the inner plain conduit 12 in the axial direction (by a threaded connection B between the plain conduit 12 and a retaining bolt H in a support body S), has a control surface E. Channels in the cylinder block 2 lead from the surface of the cylinder block 2 which faces the control surface E to the cylinder bores 5. A central boring 15 of the inner plain conduit 12 is connected to the hydraulic fluid supply channel 10*b*, while the hydraulic fluid supply channel 10*a* is in communication with an annular channel 16 formed between the inner plain conduit 12 and the outer plain conduit 13. The central boring 15 and the annular channel 16 emerge in the control body 14 in connecting channels to the control surface E.

Having described the details of the illustrated embodiment, it will be apparent that various modifications may be made without departing from the spirit and scope of the present invention. The scope of the present invention should be defined by the appended claims and equivalents thereto.

What is claimed is:

1. An axial piston machine comprising:

a housing;

a swashplate mounted in the housing;

a cylinder block provided with a torque transmission member rotationally mounted in the housing;

a bearing system located radially between the cylinder block and a housing rotationally mounting the cylinder block;

two plain conduits centrally penetrating the cylinder block and the swashplate, wherein the two plain conduits are coaxial to each other and are connected on the swashplate-side ends to hydraulic fluid supply channels; and a control body, wherein the two plain conduits emerge on the cylinder-block-side ends in the control body which has a control surface that interacts with the cylinder block, and wherein the control body is located inside the cylinder block.

2. The axial piston machine as claimed in claim 1, wherein the plain conduits are supported in a swashplate mounting and in the cylinder block.

3. The axial piston machine as claimed in claim 1, wherein the bearing system is realized so that it can absorb the forces generated by the drive system as well as external forces.

4. The axial piston machine as claimed in claim 1, wherein the axial piston machine is realized in the form of a wheel motor.

5. The axial piston machine as claimed in claim 4, wherein the transmission member is a rim drive flange shaped onto the cylinder block.

6. The axial piston machine as claimed in claim 4, further including a rim centering device shaped onto the cylinder block.

7. The axial piston machine as claimed in claim 1, wherein the bearing system is two conical roller bearings in an O-arrangement.

8. The axial piston machine as claimed in claim 1, wherein the swashplate is pivotably mounted in a swashplate mounting.

9. The axial piston machine as claimed in claim 8, wherein the plain conduits are supported in the swashplate mounting.

10. An axial piston machine comprising:

a housing;

a swashplate mounted in the housing;

a cylinder block provided with a torque transmission member rotationally mounted in the housing;

a bearing system located radially between the cylinder block and a housing rotationally mounting the cylinder block;

two plain conduits centrally penetrating the cylinder block and the swashplate, wherein the two plain conduits are coaxial to each other and are connected on the swashplate-side ends to hydraulic fluid supply channels;

a control body, wherein the two plain conduits emerge on the cylinder-block-side ends in the control body which has a control surface that interacts with the cylinder block; and a brake located radially between the cylinder block and the housing.

11. The axial piston machine as claimed in claim 10, wherein the brake is located axially between two tapered roller bearings of the bearing system.

12. An axial piston machine comprising:

a housing;

a swashplate mounted in the housing;

a cylinder block provided with a torque transmission member rotationally mounted in the housing;

a bearing system located radially between the cylinder block and a housing rotationally mounting the cylinder block;

two plain conduits centrally penetrating the cylinder block and the swashplate, wherein the two plain conduits are coaxial to each other and are connected on the swashplate-side ends to hydraulic fluid supply channels;

a control body, wherein the two plain conduits emerge on the cylinder-block-side ends in the control body which has a control surface that interacts with the cylinder a spring-loaded multiple disk brake located radially between the cylinder block and the housing.

13. An axial piston machine comprising:

a housing;

a swashplate mounted in the housing;

a cylinder block provided with a torque transmission member rotationally mounted in the housing;

a bearing system located radially between the cylinder block and a housing rotationally mounting the cylinder block;

two plain conduits centrally penetrating the cylinder block and the swashplate, wherein the two plain conduits are coaxial to each other and are connected on the swashplate-side ends to hydraulic fluid supply channels;

a control body, wherein the two plain conduits emerge on the cylinder-block-side ends in the control body which has a control surface that interacts with the cylinder block, and wherein the bearing system is two conical roller bearings in an O-arrangement; and a brake located radially between the cylinder block and the housing and between the roller bearings.

14. The axial piston machine as claimed in claim 13, further including a spring-loaded multiple disk brake located radially between the cylinder block and the housing.

15. An axial piston machine comprising:

a housing;

a swashplate mounted in the housing;

a cylinder block provided with a torque transmission member rotationally mounted in the housing;

a bearing system located radially between the cylinder block and a housing rotationally mounting the cylinder block;

two plain conduits centrally penetrating the cylinder block and the swashplate, wherein the two plain conduits are coaxial to each other and are connected on the swashplate-side ends to hydraulic fluid supply channels;

a control body, wherein the two plain conduits emerge on the cylinder-block-side ends in the control body which has a control surface that interacts with the cylinder block, wherein the swashplate is pivotably mounted in a swashplate mounting, and wherein the plain conduits are supported in the swashplate mounting; and a brake located radially between the cylinder block and the housing.

16. The axial piston machine as claimed in claim 15, wherein the brake is located axially between two tapered roller bearings of the bearing system.

17. The axial piston machine as claimed in claim 16, wherein the control body is located inside the cylinder block.

18. The axial piston machine as claimed in claim 17, wherein the axial piston motor is a wheel motor and, wherein the transition member is a rim drive flange shaped onto the cylinder block.

19. The axial piston machine as claimed in claim 18, further including a rim centering device shaped onto the cylinder block.

* * * * *

UNITED STATES PATENT AND TRADEMARK OFFICE

CERTIFICATE OF CORRECTION

PATENT NO. : 6,701,824 B2
DATED : March 9, 2004
INVENTOR(S) : Franz Forster

It is certified that error appears in the above-identified patent and that said Letters Patent is hereby corrected as shown below:

Column 4,
Lines 22-23, "cylinder a spring-loaded" should read -- cylinder block; and [new paragraph] a spring-loaded --.

Signed and Sealed this

Tenth Day of August, 2004

JON W. DUDAS
*Acting Director of the United States Patent and Trademark Office*